US010442595B2

(12) United States Patent
Grove et al.

(10) Patent No.: US 10,442,595 B2
(45) Date of Patent: Oct. 15, 2019

(54) MULTI-COMPARTMENT FOOD PACKAGE WITH SUSPENDED TOPPING CONTAINER

(71) Applicants: James E Grove, Marina Del Rey, CA (US); Amir Tamshe, Rancho Cucamonga, CA (US)

(72) Inventors: James E Grove, Marina Del Rey, CA (US); Amir Tamshe, Rancho Cucamonga, CA (US)

( * ) Notice: Subject to any disclaimer, the term of this patent is extended or adjusted under 35 U.S.C. 154(b) by 121 days.

(21) Appl. No.: 15/722,415

(22) Filed: Oct. 2, 2017

(65) Prior Publication Data

US 2019/0100367 A1 Apr. 4, 2019

(51) Int. Cl.

*B65D 77/04* (2006.01)
*B65D 81/32* (2006.01)
*B65D 21/02* (2006.01)

(52) U.S. Cl.

CPC ..... *B65D 77/0486* (2013.01); *B65D 21/0222* (2013.01); *B65D 81/3216* (2013.01); *B65D 2577/041* (2013.01); *B65D 2581/3432* (2013.01)

(58) Field of Classification Search

CPC ..... B65D 77/00–0486; B65D 81/00–3216; B65D 2577/00–041

See application file for complete search history.

(56) References Cited

U.S. PATENT DOCUMENTS 3,070,275 A * 12/1962 Bostrom ..... B65D 51/28 229/4.5
3,985,990 A * 10/1976 Levinson ..... A47J 36/027 219/729
4,306,133 A * 12/1981 Levinson ..... H05B 6/6494 219/730
4,697,703 A * 10/1987 Will ..... A61F 2/0095 206/363
4,923,702 A * 5/1990 Powell ..... A47G 19/2205 206/19
4,923,704 A * 5/1990 Levinson ..... A47J 36/027 219/730
4,939,332 A * 7/1990 Hahn ..... B65D 81/3453 219/734
5,584,388 A * 12/1996 Johnson ..... A47G 19/2227 206/19
8,006,839 B2 * 8/2011 Hafner ..... A61F 2/0095 206/363
8,613,249 B2 * 12/2013 France ..... A23L 5/13 220/23.87

(Continued)

*Primary Examiner* — Kareen K Thomas
(74) *Attorney, Agent, or Firm* — Morland C. Fischer

(57) ABSTRACT

A multi-compartment food package is disclosed including a food bowl to hold a first food (e.g., hummus) and an independent second food container to hold a second food (e.g., a topping to be added to the first food). In one embodiment, a peel-off film is removably attached across the first food container below the top thereof. A lid is detachably connected to the first food container to surround the second food container. The lid has an annular container retaining groove formed therein and extending downwardly therefrom towards the first food container. The second food container is surrounded and frictionally engaged by the annular container retaining groove, whereby the second food container is removably attached to and suspended downwardly from the lid to be received through the top of the first food container and seated on the peel-off film located below the top thereof.

21 Claims, 5 Drawing Sheets

(56) References Cited

U.S. PATENT DOCUMENTS 8,772,685 B2 * 7/2014 Backaert ..... A47J 27/04 219/682
8,912,474 B2 * 12/2014 Parsons ..... H05B 6/6408 219/734
8,939,312 B1 * 1/2015 Buck ..... A47G 19/065 220/212
9,078,535 B1 * 7/2015 Buck ..... A47G 19/2205
9,132,951 B2 * 9/2015 Parsons ..... B65D 77/046
9,617,061 B2 * 4/2017 Rasanen ..... B65D 43/022
2005/0051549 A1 * 3/2005 Nelson ..... B65D 21/0219 220/23.83
2007/0116806 A1 * 5/2007 Parsons ..... B65D 77/046 426/107
2007/0116807 A1 * 5/2007 Parsons ..... B65D 77/046 426/107
2007/0172554 A1 * 7/2007 Blythe ..... B65D 11/188 426/106
2008/0230176 A1 * 9/2008 Van De Weijer ..... B29C 45/14811 156/245
2009/0107993 A1 * 4/2009 Ohyama ..... A47J 27/10 219/731
2009/0297673 A1 * 12/2009 Sebban ..... B65D 81/3453 426/107
2011/0163102 A1 * 7/2011 Haynie ..... B65D 51/28 220/521
2012/0138608 A1 * 6/2012 Rusnak et al. ..... B65D 43/0208 220/23.87
2013/0068772 A1 * 3/2013 Durdon ..... B65D 43/0212 220/521
2015/0232242 A1 * 8/2015 Carlson ..... B65D 53/02 220/367.1
2015/0351893 A1 * 12/2015 Smith ..... A61F 2/0095 623/16.11
2016/0175893 A1 * 6/2016 Chapotat ..... B24B 31/112 220/660

* cited by examiner

MULTI-COMPARTMENT FOOD PACKAGE WITH SUSPENDED TOPPING CONTAINER

BACKGROUND OF THE INVENTION

1. Field of the Invention

This invention relates to a multi-compartment food package including a food bowl in which a food (e.g., hummus) is packaged, an independent topping container in which a topping is packaged, and a lid that is detachably connected to the top of the food bowl to enclose the topping container. The topping container is suspended from the lid so as to be held above a peel-off film that extends over and across the food bowl. The food package herein disclosed has particular application to be subjected to a high pressure processing (HPP) treatment by which potentially harmful food-borne pathogens and similar organisms are eliminated while an unintended mixing of the food and the topping is avoided prior to their being consumed.

2. Background Art

It is known to expose packaged food to a conventional high pressure processing (HPP) treatment to eliminate food-borne pathogens and similar organisms. Briefly, the packaged food is held in water under extreme pressure so as to advantageously make the food safe for consumption and extend the refrigerated shelf life thereof. However, the high pressure to which the packaged food is subjected causes the food within the package to be mixed prior to its time of consumption which has, in some circumstances, been known to cause problems for food distributors and consumers alike. By way of one example, hummus is usually sold to consumers in a clear container. A colorful and tasty topping is traditionally added so as to lie on top of the hummus at which to be visible through the container in order to enhance the commercial appeal of the hummus to consumers. If the container is subjected to the high pressure HPP treatment, an unintended consequence of such treatment is that the topping is prematurely mixed with the hummus. When the hummus reaches the shelf of a retail store, the consumer is able to look through the clear container and see the mixture of hummus and topping which can be visually less appealing to the consumer than had the hummus and its topping remained separate and intact one above the other. Thus, the consumer may not be as inclined to purchase the high pressure HPP treated hummus which costs both the food distributor and the retailer a sale and may result in the hummus not being purchased at all.

Pending patent application Ser. No. 15/630,856 filed Jun. 22, 2017 describes one example of a multi-compartment food package in which a food, such as hummus, or the like, and an independent topping can be packaged and kept separate from one another before, during and after the container is subjected to an HPP treatment to thereby avoid the hummus and its topping from being prematurely mixed together prior to their consumption. In that case, the topping container is turned upside down so that the top of the container is seated on a food bowl. In the present case, another example of a multi-compartment food package is described that is capable of solving the problem described above, wherein the independent topping container is turned top side up so that the bottom of the topping container is seated on the food bowl.

SUMMARY OF THE INVENTION

In general terms, a multi-compartment food package is disclosed including a food bowl that is filled with a food, such as hummus or the like, and an independent topping container that is filled with a topping to be added to the food bowl and mixed with the food. Both the food bowl and the topping container are preferably manufactured from a visually transparent material that is adapted to withstand a high pressure processing (HPP) treatment by which to eliminate potentially harmful food-borne pathogens and similar organisms in the hummus and the topping with which the food bowl and the topping container are filled. The food bowl has a peripheral lip surrounding an open top and a peel-off film extending across the food bowl to prevent the hummus from spilling out. The independent topping container has a peripheral lip which surrounds an open top and a peel-off film by which to close the open top of the topping container and prevent the topping from spilling out. A visually transparent and flexible lid is detachably connected to the top of the food bowl at the peripheral lip thereof to surround the topping container.

The flexible lid that is detachably connected to the top of the food bowl has an annular topping container retaining groove formed therein and extending downwardly therefrom. The inner wall of the topping container retaining groove is adapted to be pushed outwardly and momentarily bent from its normal vertical orientation at which to establish a small angle. When the inner wall of the groove is pushed outwardly, it becomes stressed and stores energy.

In a first embodiment, there is a space located below the open top of the food bowl and above the peel-off film which extends across and closes the food bowl. The independent topping container is attached to and suspended from the lid when the peripheral lip of the topping container is moved into frictional engagement against the inner wall of the topping container retaining groove. The inner wall is thusly bent outward, and the top of the topping container is held in place against the bottom of the lid by means of its frictional engagement by the inner wall of the retaining groove. In this first embodiment, the bottom of the topping container extends downwardly through the open top of the food bowl for receipt within the space below the open top of the food bowl so as to be seated on the peel-off film which extends across the food bowl below the open top thereof.

In a second embodiment, the peel-off film extends over and across the open top of the food bowl. In this second embodiment, when the top of the topping container is suspended from the lid as just described, the bottom of the downwardly hanging topping container is located above the top of the food bowl and seated on the peel-off film that extends over and across the open top thereof.

DESCRIPTION OF THE PREFERRED EMBODIMENT

Figure 1:
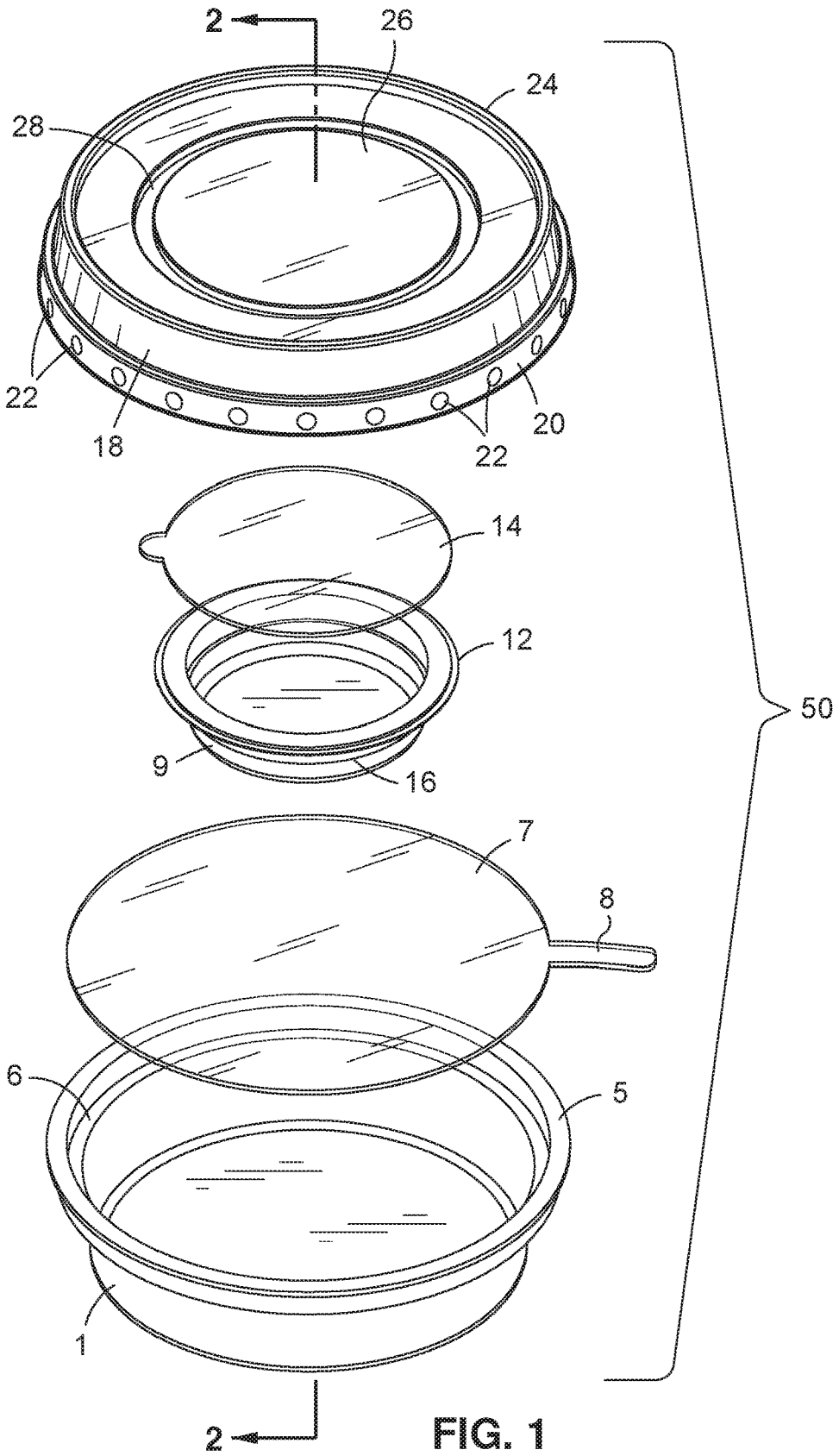
FIG. 1 is an exploded view of a first multi-compartment food package which includes a food bowl located at the bottom of the food package, a lid located at the top of the food package to be detachably connected to the top of the food bowl, and an independent topping container to be held in place between the lid and the food bowl.
Figure 2:
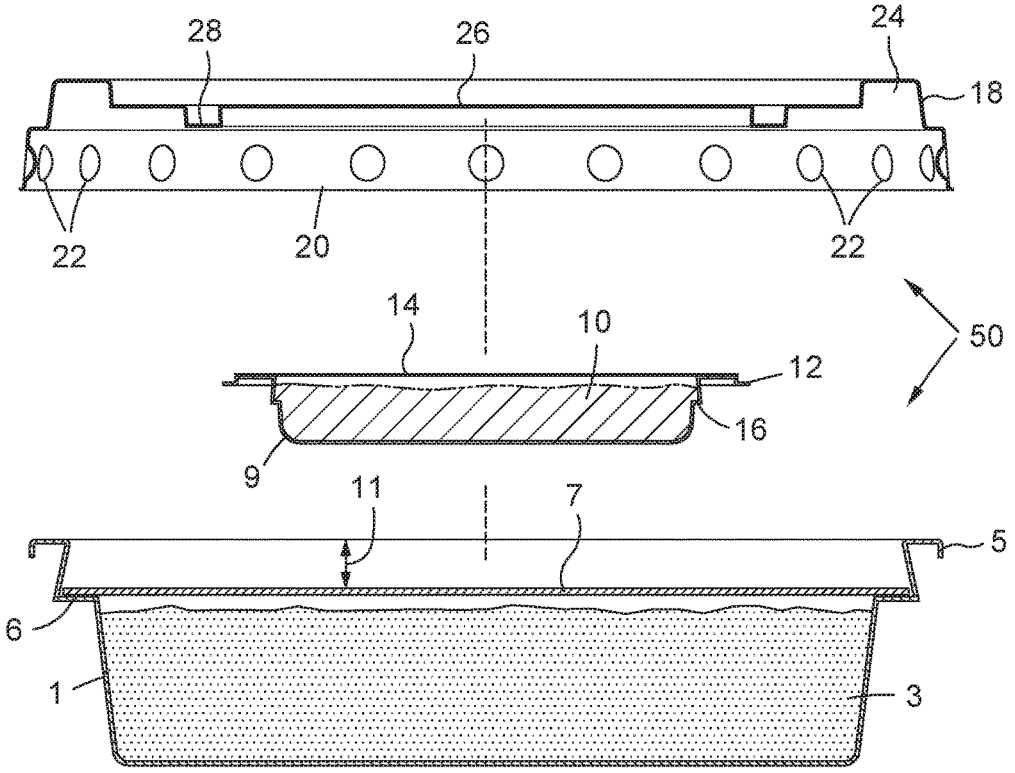
FIG. 2 is another exploded view of the first multi-compartment food package shown in FIG. 1 with the food bowl filled with a food (e.g., hummus) and the topping container filled with a topping to be added to the food bowl and mixed with the food therein.
Figure 3:
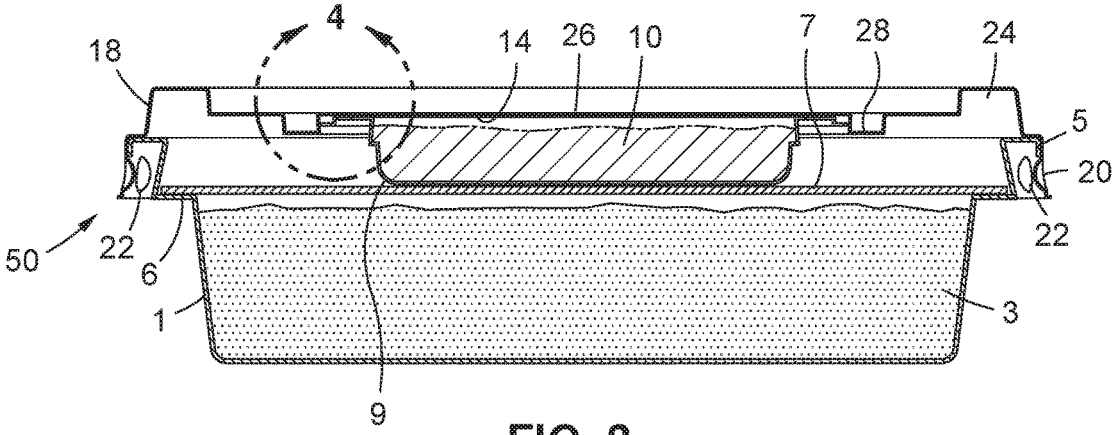
FIG. 3 is a cross-section of the first multi-compartment food package shown in FIG. 2 with the food bowl, lid and topping container interconnected to one another.

Referring initially to FIGS. 1-3 of the drawings, there is shown a multi-compartment food package 50 that includes a food bowl 1 of the kind that is capable of holding a food 3 prior to its consumption. By way of example only, the food 3 within the food bowl 1 is hummus. However, it is to be understood that other foods besides hummus can be packaged within the food bowl 1, especially those to which a topping will be added during consumption for the purpose of enhancing the taste of the food. In this regard, another example of a food 3 to be held by and packaged within the food bowl 1 is yogurt.

The food bowl 1 is preferably manufactured from a flexible, clear and visually transparent (e.g., plastic) material so that consumers can see the food 3 that is packaged therein. The food bowl 3 has an open top and a peripheral lip 5 that extends outwardly from and surrounds the open top. As an important feature, a peripheral sealing flange or ledge 6 extends inwardly from the food bowl 1 below the open top thereof. A peel-off film 7 is sealed to the peripheral ledge 6 below the open top of the food bowl to extend across and cover the bowl 1 in order to create a fluid-tight seal and prevent the food contents from spilling out. As best shown in FIG. 2, the peel-off film 7 is located at the bottom of a space 11 that extends from the peripheral lip 5 that surrounds the open top of the food bowl 1 and the peripheral ledge 6 of the food bowl 1 against which the peel-off film 7 is sealed. A flexible pull tab 8 (best shown in FIG. 1) extends from the peel-off film 7 to which a pulling force is applied when it is desirable to remove the film 7 from the food bowl 1 to gain access to the food 3 that is packaged therewithin.

The multi-compartment food package 50 also includes a container 9 which is separate from and independent of the food bowl 1. The container 9 is filled with a topping 10 that can be added to and mixed with the food 3 that is packaged within food bowl 1 at the time the food 3 is consumed. However, prior to removing the peel-off film 7 from the food bowl 1 to access the food 3, it is preferable to separate the topping 10 from the food 3 to prevent their being prematurely mixed together.

As in the case of the food bowl 1, the topping container 9 of the food package 50 is preferably manufactured from a flexible, clear and visually transparent (e.g., plastic) material to make the topping 10 that is packaged therein visible to consumers. The topping container 9 has an open top and a peripheral lip 12 that extends outwardly from and around the open top. A peel-off film 14 is sealed to the peripheral lip 12 to extend over and cover the top of the container 9 and create a fluid-tight seal to prevent the topping 10 from spilling out. The topping container 9 also has an angled peripheral ridge 16 extending outwardly therefrom below the open top. The angled peripheral ridge 16 creates a separation and thereby allows the topping container 9 to be easily detached from other containers in a stack of containers (not shown) when the container 9 is transported or stored in such a stack.

By way of example, where hummus is the food 3 packaged within the food bowl 1, the topping 10 that is packaged within the independent topping container 9 to be added to the hummus is typically a mixture of oil, pine nuts, spices, and the like. However, if yogurt were to be the food 3 that is packaged within the food bowl 1, the topping 10 to be packaged within the independent topping container 9 to be added to the yogurt will typically be granola and/or fruit. By way of still another example, the food 3 may be a salad and the topping 10 can be salad dressing. In any event, it is to be understood that the specific food 3 within the food container 1 and the topping 10 within the independent topping container 9 to be added to and mixed with the food 3 prior to their consumption are not to be considered as a limitation of this invention.

It is contemplated that the food 3 packaged within the food bowl 1 and the topping 10 packaged within the independent topping container 9 of the food package 50 will be subjected to a conventional high pressure processing (HPP) treatment prior to their distribution to the public for consumption. In this case, it is desirable to prevent the premature mixing of the food 3 and the topping 10 as may occur due to the pressure created during the HPP process if the food 3 and the topping 10 were packaged together in a single container with the topping 10 simply placed above the food 3. Any such premature mixing of the topping 10 with the food 3 prior to their consumption can negatively affect the visual and commercial appeal as well as a consumer's perception and decision to buy the food 3 that is packaged within and visible through the clear food bowl 1.

To overcome this potential problem, the multi-compartment food package 50 is assembled when a lid 18 having a closed top is detachably connected to the top of the food bowl 1 with the independent topping container 9 located therebetween and suspended from the lid 18. The lid 18 is ideally manufactured from a clear, visually transparent (e.g., plastic) material that is flexible. A generally cylindrical peripheral base 20 surrounds the bottom of the flexible lid 18. A set of radially inward projecting locking detents 22 are formed in and spaced from one another around the peripheral base 20 of lid 18.

As is best shown in FIG. 3, when the lid 18 of the food package 30 is detachably connected to the top of the food bowl 1, the peripheral base 20 of lid 18 is moved into surrounding engagement with the peripheral lip 5 of the food bowl 1. The peripheral base 20 of the flexible lid 18 is initially stressed and bent outwards to be able to accommodate the peripheral lip 5 of the food bowl 1 thereunder. When the flexible lid 18 relaxes and returns to its pre-stressed shape, the inward projecting locking detents 22 that are formed in and around the peripheral base 20 of lid 18 are snapped into receipt against and below the peripheral lip 5 of the food bowl 1 by which the lid 18 is held in place over and across the food bowl.

The flexible lid 18 has a raised peripheral rim 24 extending around and standing upwardly therefrom. Located at the center of the closed top of the lid 18 and surrounded by and lying below the raised peripheral rim 24 is a stacking recess 26. As another important feature, an annular topping container retaining channel or groove 28 is formed in and extends downwardly from the stacking recess 26 that is surrounded by the raised peripheral rim 24 of the lid 18. The purpose of the retaining groove 28 formed in the lid 18 will soon be described.

Figure 5:
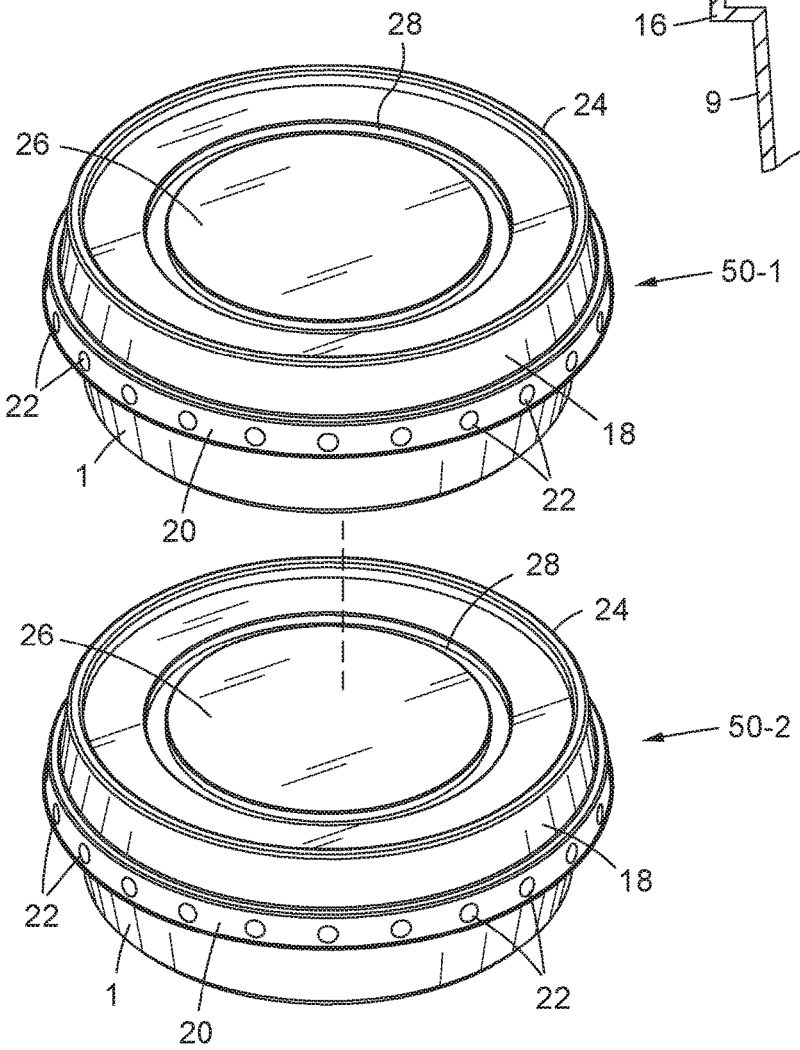
FIG. 5 shows a pair of the first multi-compartment food packages to be stacked one above the other.
Figure 6:
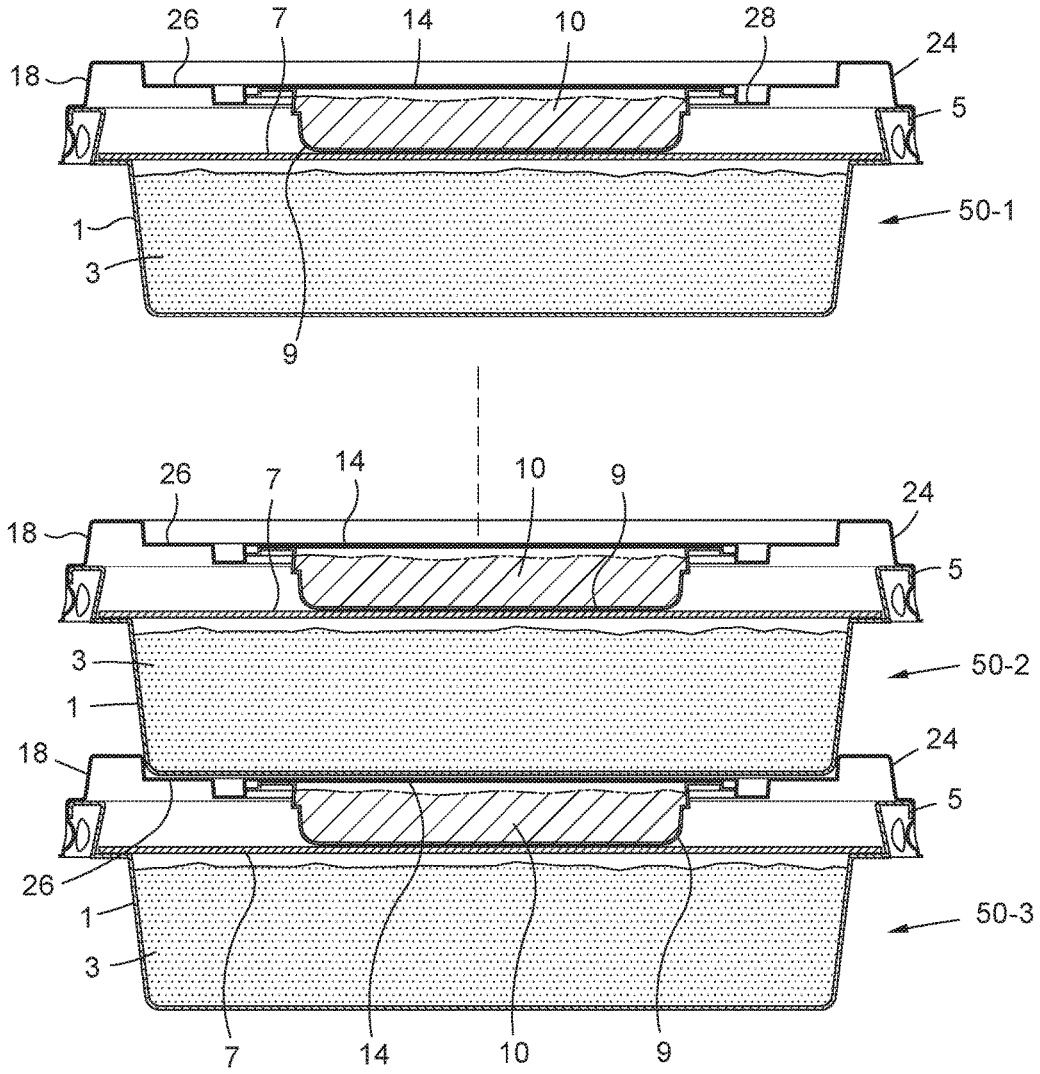
FIG. 6 is a cross-section showing a plurality of the first multi-compartment food packages arranged in a vertical stack with one food package lying above the other.

Referring briefly to FIGS. 5 and 6 of the drawings, the raised peripheral rim 24 and the stacking recess 26 that is surrounded by the rim cooperate to enable a plurality of identical multi-compartment food packages 50-1, 50-2 and 50-3 to be nested together one above the other in a vertical stack. More particularly, the food bowl 1 of a first upper food package (designated 50-2 in FIG. 6) is laid on top of the lid 18 of a second lower food package 50-3. The bottom of the food bowl 1 from the upper food package 50-2 is sized to be received within the peripheral rim 24 and seated on the stacking recess 26 of the lower food package 50-3. Thus, the bottom of the food bowl 1 of the upper food package 50-2 is surrounded by the raised peripheral rim 24 that stands upwardly from the lid 18.

Accordingly, the bottom of the upper food package 50-2 is seated on the top of the lower food package 50-3 and disposed in a compact vertical stack that may include one or more additional food packages (e.g., designated 50-1 in FIGS. 5 and 6) to facilitate the shipping or storage of the stack and any food that may be carried in the food bowls 1 and the topping containers 9. The raised peripheral rims 24 within which the bottoms of the food bowls 1 are located advantageously prevent an upper food package (e.g., 50-2) from sliding off the lid 18 atop a lower food package (e.g., 50-3). When needed, the upper food package 50-2 may be simply lifted upwardly from and off the lower food package 50-3.

Figure 4:
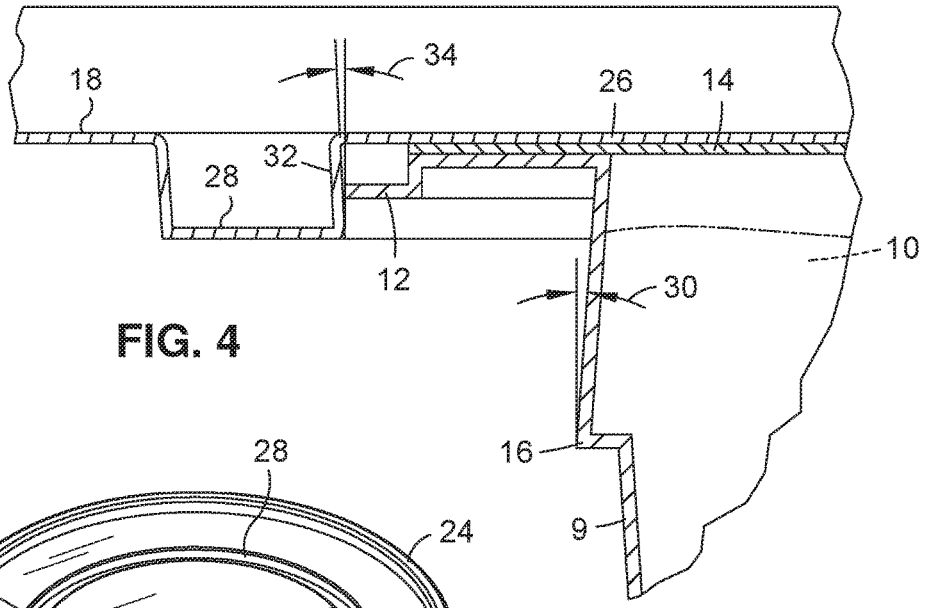
FIG. 4 is an enlarged detail taken from FIG. 3 to illustrate the topping container suspended from the lid.

Turning now to FIGS. 3 and 4 of the drawings, details are provided for removably attaching the independent topping container 9 to the lid 18 of the food package 50 such that the topping container is suspended from the lid above the food bowl 1. As is best shown in FIG. 4, a portion of the flexible topping container 9 lying between the peripheral ridge 16 and the peripheral lip 12 thereof is capable of being pressed and momentarily bent inwardly to form a small angle 30 with a vertical reference line which extends upwardly from the peripheral ridge 16 of container 9. Likewise, the wall 32 at one side of the topping container retaining groove 28 that extends below the lid 18 to lie closest to the topping container 9 is capable of being pushed and momentarily bent outwardly and away from container 9 to form a small angle 34 with a vertical reference line that extends upwardly from the bottom of groove 28. When the topping container 9 and the side wall 32 of the topping container retaining groove 28 are bent, they become stressed and store energy.

In order for the multi-compartment food package 50 of FIGS. 3 and 4 to be fully assembled and made ready for visual inspection and purchase by a consumer, the lid 18 is detachably connected to the food bowl 1 at the peripheral lip 5 thereof in the manner previously disclosed. However, prior to attaching the lid 18 to the food bowl 1, the top of the independent topping container 9 is removably attached to the bottom of the lid 18 so that the container 9 is suspended and hanging down from the lid. The peel-off film 14 which covers the container 9 will now lie below and against the stacking recess 26 at the center of lid 18. Thus, the top of the topping container 9 is surrounded by the topping container retaining groove 28 which is formed in and extends downwardly from the lid 18.

With the topping container 9 moved below the lid 18 and the peel-off film 14 which covers the top of the topping container 9 lying flush against the stacking recess 26 of the lid 18, the outwardly extending peripheral lip 12 at the top of the topping container 9 is moved towards the side wall 32 of the topping container retaining groove 28 that lies adjacent thereto. The energy stored by the side wall 32 and the topping container 9 as a result of their being initially bent and stressed is now released to cause the peripheral lip 12 of topping container 9 and the adjacent side wall 32 to relax and automatically move into releasable frictional engagement with one another. The topping container retaining groove 28 of the lid 18 thusly holds the top of the topping container 9 in place below the stacking recess 26 by means of a friction fit therebetween so that the container 9 is suspended downwardly from the bottom of the lid 18. The bottom of the topping container 9 is seated upon and supported by the peel-off film 7 that extends across and covers the food bowl 1.

As is best shown in FIG. 3, when the lid 18 is detachably connected to the peripheral lip 5 at the top of the food bowl 1, the lid 18 from which the topping container 9 is suspended encloses the topping container 9 so that the container will be carried within the food package 50 between the lid and the food bowl. However, because the peel-off film 7 of the food bowl 1 is attached to the peripheral ledge 6 that is located at the bottom of the space (designated 11 in FIG. 2) and below the open top of the food bowl 1, the topping container 9 that is seated on the peel-off film 7 is received downwardly through the open top and inwardly of the food bowl 1 so as to lie below the peripheral lip 5 that surrounds the open top of the food bowl to which the lid 18 is detachably connected. By virtue of the foregoing, a compact multi-compartment food package 50 is established which conserves space and reduces volume consumption especially when a plurality of food packages (e.g., 50-1, 50-2 and 50-3) are stacked vertically one on top of the other as shown in FIG. 6. In this same regard, the contents of the independent topping container 9 and the food bowl 1 are transported adjacent to but separate from one another until the time when the contents are to be mixed together and consumed.

When it is desirable to mix and consume the contents of the food bowl 1 and the independent topping container 9, the lid 18 of the food package 50 is detached (i.e., pulled upwardly) from and off the top of the food bowl 1. The topping container 9 is then separated (i.e., pulled downwardly) from and out of its frictional engagement with the topping container retaining groove 28 of the lid 18. The peel-off films 7 and 14 are then removed from the food bowl 1 and the topping container 9. Finally, the contents 10 of the topping container 9 are poured into the food bowl 1 and mixed with the contents 3 thereof. The mixture is then ready to be consumed to the eating pleasure of the consumer.

Figure 7:
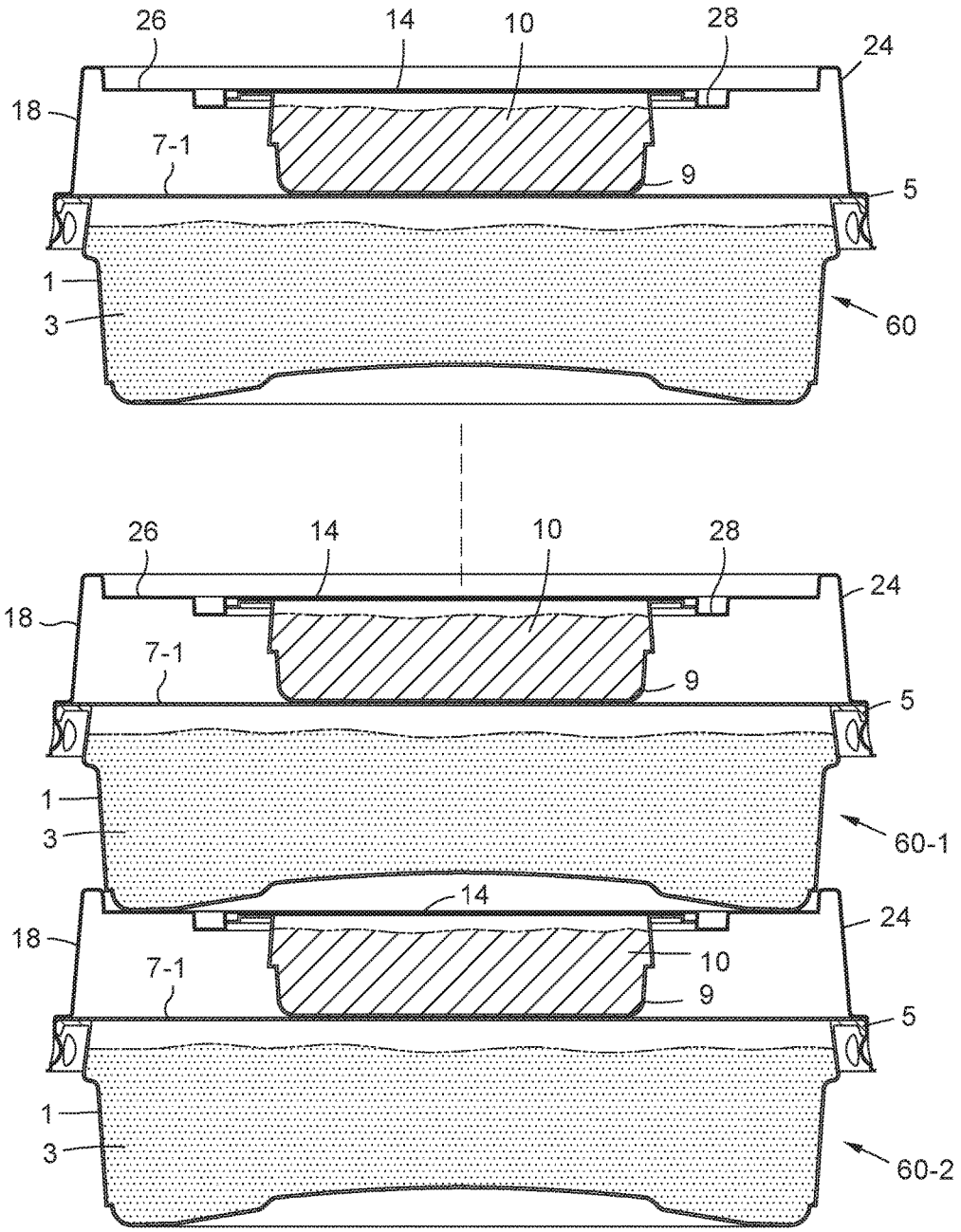
FIG. 7 is a cross-section showing a plurality of different multi-compartment food packages also arranged in a vertical stack with one food package lying above the other.

FIG. 7 of the drawings shows another multi-compartment food package 60 that includes many of the same features as the food package 50 that was previously described while referring to FIGS. 1-4 of the drawings. Therefore, similar reference numbers have been used to indicate those features which are common to both food packages 50 and 60. As with the food package 50, the food package 60 shown in FIG. 7 includes a food bowl 1 in which a food 3 (e.g., hummus) is carried, an independent topping container 9 in which a topping 10 is carried to be added to food bowl and mixed with the food therein when the food is consumed, and a lid 18 detachably connected to the food bowl to surround the topping container 9. Also like the food package 50, the top of the topping container 9 is suspended and hangs downwardly from the bottom of the lid 18 towards the food bowl 1 in the manner shown in FIG. 4.

However, in the case of the multi-compartment food package 60, a peel-off film 7-1 is sealed against the outwardly extending peripheral lip 5 of the food bowl 1 so as to extend over and across the open top of the food bowl 1 as opposed to lying below the open top. Accordingly, when it is suspended from the lid 18, the topping container 9 is held entirely above the food bowl 1, such that the bottom of the topping container 9 is seated on the peel-off film 7-1 that extends across and covers the open top of the food bowl.

Similar to that shown in FIG. 6, FIG. 7 shows a plurality of the food bowls 60, 60-1, 60-2 nested together in a vertical stack with one food bowl lying above the other. That is, the bottom of the food bowl 1 from an upper food package (e.g., 60-1) is laid upon the lid 18 at the top of a lower food package (e.g., 60-2) so as to be surrounded by the raised peripheral rim 24 which stands upwardly from the lid 18 of the lower food package 60-2. Thus, the vertical stack of food packages 60, 60-1 and 60-2 can be conveniently transported or stored while preventing one food package from inadvertently sliding off the food package on which it is laid.

The invention claimed is:

1. A food package comprising:

a first food container in which a first food is carried, said first food container having an open top, a closed bottom and a closure removably attached across said first food container so as to lie below the open top of said first food container to retain the first food therein;

a second food container in which a second food is carried; and a lid detachably connected to said first food container so that said second food container is located between said lid and the closure of said first food container, whereby at least some of said second food container extends downwardly through the open top of said first food container, said first food container including a peripheral sealing ledge extending around the interior thereof so as to be located below the open top of said first food container and above the first food carried within said first food container, said closure being removably attached to said peripheral sealing ledge so as to lie below the open top of and across said first food container to retain the first food therein.

2. The food package recited in claim 1, wherein the closure that is removably attached to the peripheral sealing ledge so as to lie below the open top of and across said first food container to retain the first food therein is a peel-off film.

3. The food package recited in claim 2, wherein said peel-off film has a pull tab extending outwardly therefrom and being responsive to a manual pulling force applied thereto whereby to remove said peel-off film from said first food container to permit access to the first food carried therein.

4. The food package recited in claim 2, wherein said second food container is seated on the peel-off film that is removably attached across the first food container and lies below the open top of said first food container when said lid is detachably connected to said first food container.

5. The food package recited in claim 2, wherein said lid has a peripheral base extending therearound and a set of locking detests formed in said peripheral base, and the open top of said first food container has a peripheral lip extending therearound, said set of locking detents from the peripheral base of said lid being located under and engaged by the peripheral lip of said first food container when said lid is detachably connected to said first food container, said peel-off film extending across said first food container below the peripheral lip that extends around the open top thereof.

6. The food package recited in claim 1, wherein the first food carried by said first food container is hummus, and the second food carried by said second food container is a hummus topping including at least a spice.

7. The food package recited in claim 1, wherein each of said first food container, said second food container, and said lid is manufactured from a flexible, visually transparent material so that said first and second foods are visible through said lid and said first and second food containers.

8. The food package recited in claim 1, wherein said lid that is detachably connected to said first food container has a stacking recess formed therein and surrounded by a peripheral rim which stands upwardly from said lid above said stacking recess, said stacking recess having a size that corresponds to the size of the closed bottom of said first food container.

9. The food package recited in claim 1, wherein said second food container is removably attached to and suspended from said lid so as to hang downwardly therefrom, whereby said second food container is held between said lid and said closure that is removably attached across said first food container below the open top thereof.

10. The food package recited in claim 9, wherein said lid has a container retaining groove formed therein and extending downwardly therefrom towards said first food container when said lid is detachably connected to said first food container, said second food container being engaged and held in place by said container retaining groove, whereby said second food container is removably attached to and suspended from said lid so as to hang downwardly therefrom.

11. The food package recited in claim 10, wherein said second food container is surrounded and frictionally engaged by the container retaining groove that is formed in and extends downwardly from said lid.

12. The food package recited in claim 10, wherein the container retaining groove that is formed in and extends downwardly from said lid has a flexible wall that surrounds and lies in frictional engagement with said second food container by which said second food container is removably attached to and suspended from said lid to hang downwardly therefrom.

13. The food package recited in claim 12, wherein said second food container has an open top, a closed bottom, and a peel-off film removably attached to and extending across the open top of said second food container to retain the second food therein, said peel-off film lying flush against the lid when said second food container is engaged by the container retaining groove that is formed in the lid and the second food container is removably attached to and suspended from the lid.

14. The food package recited in claim 13, wherein the closed bottom of said second food container is seated on the closure that is removably attached across said first food container when said second food container is removably attached to and suspended from said lid to hang downwardly therefrom.

15. A food package comprising:

a first food container in which a first food is carried, said first food container having a top, a closed bottom and a first closure removably attached across said first food container to retain the first food therein;

a second food container in which a second food is carried, said second food container having a top, a closed bottom and a second closure removably attached across said second food container to retain the second food therein; and a lid detachably connected to said first food container to surround said second food container, said lid having a container retaining groove formed therein and extending downwardly therefrom towards said first food container when said lid is detachably connected to said first food container, said second food container being frictionally engaged by said container retaining groove, whereby said second food container is removably attached to and suspended from said lid so as to hang downwardly therefrom above said first closure that is removably attached across said first food container.

16. The food package recited in claim 15, wherein the closed bottom of said second food container is seated on the first closure that is removably attached across said first food container when said second food container is removably attached to and suspended from said lid.

17. The food package recited in claim 15, wherein said first closure is a peel-off film and said first food container has a peripheral lip extending outwardly from the top thereof to which said lid is detachably connected, said peel-off film being sealed against said peripheral lip so as to extend across the top of said first food container.

18. The food package recited in claim 15, wherein said first closure is a peel off film, said first food container having a peripheral lip extending outwardly from the top thereof to which said lid is detachably connected and a peripheral sealing ledge extending inwardly from and around said first food container below said peripheral lip, said peel-off film being sealed against said peripheral ledge so as to extend across said first food container below the peripheral lip thereof.

19. A food package comprising:

a first food container in which a first food is carried, said first food container having an open top, a closed bottom and a first closure removably attached across said first food container so as to lie below the open top of said first food container to retain the first food therein;

a second food container in which a second food is carried; and a lid detachably connected to said first food container so that said second food container is located between said lid and the closure of said first food container, whereby at least some of said second food container extends downwardly through the open top of said first food container, said lid having a container retaining groove formed therein and extending downwardly therefrom towards said first food container when said lid is detachably connected to said first food container, said second food container being engaged by said container retaining groove, such that said second food container is removably attached to and suspended from said lid so as to hang downwardly therefrom and be held in place between said lid and said closure.

20. The food package recited in claim 19, wherein said second food container is surrounded and frictionally engaged by the container retaining groove that is formed in and extends downwardly from said lid.

21. The food package recited in claim 19, wherein the container retaining groove that is formed in and extends downwardly from said lid has a flexible wall that surrounds and lies in frictional engagement with said second food container by which said second food container is removably attached to and suspended from said lid to hang downwardly therefrom.

* * * * *